US010179401B2

(12) United States Patent
Nyland

(10) Patent No.: US 10,179,401 B2
(45) Date of Patent: Jan. 15, 2019

(54) PIVOTAL ARM SUPPORT DEVICE

(71) Applicant: Thomas John Nyland, Eden Prairie, MN (US)

(72) Inventor: Thomas John Nyland, Eden Prairie, MN (US)

( * ) Notice: Subject to any disclaimer, the term of this patent is extended or adjusted under 35 U.S.C. 154(b) by 0 days.

(21) Appl. No.: 15/694,502

(22) Filed: Sep. 1, 2017

(65) Prior Publication Data

US 2018/0126539 A1 May 10, 2018

Related U.S. Application Data

(60) Provisional application No. 62/383,329, filed on Sep. 2, 2016.

(51) Int. Cl.
*B25G 1/10* (2006.01)
*B25G 1/06* (2006.01)

(52) U.S. Cl.
CPC ..... *B25G 1/102* (2013.01); *B25G 1/06* (2013.01)

(58) Field of Classification Search
CPC ... Y10T 16/466; Y10T 16/476; Y10T 16/469; Y10T 16/4713; B25G 1/102; B25G 1/00; B25G 1/06; B25G 3/00; B25G 3/38; B25G 3/02; B25G 3/04; A45F 5/00; A45F 5/10; A45F 5/102; A45F 5/1026; A45F 5/1033; A01B 1/026; F16B 2/10; F16B 2/1073; F16B 2/04; F16B 2/06; F16B 2/08; F16B 2/065; F16B 2/12; B25F 5/026; B25B 25/005; F16L 33/04; F16L 33/08; F16L 33/10
See application file for complete search history.

(56) References Cited

U.S. PATENT DOCUMENTS 309,437 A * 12/1884 Calef ..... A47G 21/02 30/324
607,154 A * 7/1898 Berck ..... B25G 1/00 294/58
2,069,163 A * 1/1937 Hibner, Jr. ..... F28G 15/02 248/230.4
3,159,939 A * 12/1964 Transeau ..... A01K 87/08 224/907
3,367,056 A * 2/1968 Johnson ..... A01K 87/08 224/922
3,372,510 A * 3/1968 Arsenault ..... A01K 87/08 294/58
5,170,540 A * 12/1992 Oetiker ..... F16L 33/035 24/20 CW
5,299,344 A * 4/1994 Oetiker ..... F16L 33/035 24/19
5,313,735 A * 5/1994 Latouche ..... A01K 87/08 43/25
5,451,085 A * 9/1995 Wagner ..... A01B 1/22 16/422

(Continued)

*Primary Examiner* — Chuck Y Mah
(74) *Attorney, Agent, or Firm* — Merchant & Gould P.C.

(57) ABSTRACT

The present disclosure relates to an arm support device including a coupler adapted to be coupled to a handle, an arm support positioned above the coupler, and a pivot pin that connects the arm support to the coupler. In certain examples, the coupler has different types of size adjustment mechanisms. For example, the coupler can include a first size adjustment mechanism for providing larger adjustments in size, and a second adjustment mechanism for providing smaller adjustments in size.

21 Claims, 6 Drawing Sheets

(56) References Cited

U.S. PATENT DOCUMENTS

| | | | | | |
|---|---|---|---|---|---|
| 5,661,960 | A * | 9/1997 | Smith | A01D 34/902 | 30/276 |
| 5,809,614 | A * | 9/1998 | Kretser, Jr. | A01B 1/00 | 16/422 |
| 5,988,727 | A * | 11/1999 | Mueller | B62J 17/04 | 224/448 |
| 6,493,982 | B1 * | 12/2002 | Macaluso | A01K 87/08 | 43/21.2 |
| 6,564,389 | B1 * | 5/2003 | Laughlin | A41D 19/01529 | 2/158 |
| 6,581,246 | B1 * | 6/2003 | Polette | A01D 34/90 | 16/426 |
| 6,698,064 | B1 * | 3/2004 | Graj | A47J 45/071 | 16/422 |
| 7,533,485 | B2 | 5/2009 | Nyland | | |
| 7,752,799 | B2 | 7/2010 | Nyland | | |
| 8,307,579 | B2 | 11/2012 | Nyland | | |
| 8,317,526 | B2 * | 11/2012 | Gardner | H01R 4/36 | 24/489 |
| 8,671,523 | B1 * | 3/2014 | Day | B25G 3/20 | 16/422 |
| 2007/0209162 | A1 * | 9/2007 | McRoberts | B25F 5/026 | 16/426 |
| 2010/0132163 | A1 * | 6/2010 | Hasei | A01D 34/90 | 16/421 |
| 2010/0306968 | A1 * | 12/2010 | An | F16L 33/08 | 24/278 |
| 2011/0173778 | A1 * | 7/2011 | Wales | B25G 3/20 | 16/426 |
| 2016/0096063 | A1 * | 4/2016 | Reynolds | A63B 21/0722 | 482/139 |
| 2017/0181772 | A1 * | 6/2017 | Buttermann | A61B 17/7032 | |

* cited by examiner

PIVOTAL ARM SUPPORT DEVICE

CROSS REFERENCE TO RELATED APPLICATION

This application claims the benefit of U.S. Provisional Application No. 62/383,329, filed Sep. 2, 2016, and titled "PIVOTAL ARM SUPPORT DEVICE," the disclosure of which is hereby incorporated herein by reference.

TECHNICAL FIELD

The present disclosure relates generally to arm support devices. More particularly, the present disclosure relates to arm support devices that can pivot to accommodate wrist movement of a user.

BACKGROUND

A variety of devices are provided with handles. Example devices can include rakes, hoes, fishing rods, fishing nets, shovels, snow shovels, paint rollers and other devices. The safe, efficient and injury free use of such devices is often dependent upon effective leverage. In this regard, arm supports have been developed to provide enhanced leverage. U.S. Pat. No. 7,752,799 discloses an example pivotal arm support device that can be attached to a handle of a device to provide improved leverage.

SUMMARY

One aspect of the present disclosure relates to an arm support device that can readily be mounted on device handles having a variety of sizes. In certain examples, the arm support device can support a user's forearm while allowing the user bend his or her wrist as the handle is manipulated without disengaging the forearm from the arm support device. In certain examples, the arm support device includes an arm support that is pivotally connected to a coupler having a configuration that can accommodate a wide variety of handle sizes.

Another aspect of the present disclosure relates an arm support device for use with an item having a handle. The arm support device includes a coupler adapted to be coupled to the handle. A coupler defines a pivot opening. The coupler also includes a clamp having first and second clamp portions between which is defined a receptacle for receiving the handle of the item. The first and second clamp portions are joined by a living hinge located below the receptacle. The coupler includes a fastener passing through the first and second clamp portions at a location above the receptacle for tightening the clamp about the handle. The second clamp portion includes first and second segments that can be coupled to each other at a plurality of different positions to adjust the size of the receptacle such that the receptacle can accommodate handles of different sizes. The arm support device also includes an arm support positioned above the coupler, and a pivot pin that connects the arm support to the coupler. The pivot pin includes a lower portion that extends downwardly from the arm support to the coupler. The lower portion of the pivot pin defines a pivot axis of about which the arm support pivots relative to the coupler. The lower portion of the pivot pin is pivotally received within the pivot opening of the coupler such that the lower portion of the pivot pin pivots about the pivot axis within the pivot opening to allow the arm support to pivot relative to the coupler.

A further aspect of the present disclosure relates to an arm support device including a coupler adapted to be coupled to a handle, an arm support positioned above the coupler, and a pivot pin that connects the arm support to the coupler. In certain examples, the coupler has different types of size adjustment mechanisms. For example, the coupler can include a first size adjustment mechanism for providing micro or fine adjustments in size, and a second adjustment mechanism for providing coarse or macro adjustments in size.

Other aspects of the present disclosure relate to a coupler that can be used in combination with other structures, items or devices in addition to arm support devices. For example, a clamp of the coupler can be mounted on a fixed support structure (e.g., a mounting rail, mounting handle, mounting pole, mounting rod, etc.) such that the support structure is clamped within a receptacle of the clamp. An item (e.g., a light or lighting fixture, camera, display item, frame, shelf, guide, etc.) desired to be mounted to the fixed support structure can be mounted to the support structure through the intermediate coupler.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts underlying the examples disclosed herein.

DETAILED DESCRIPTION

Figure 1:
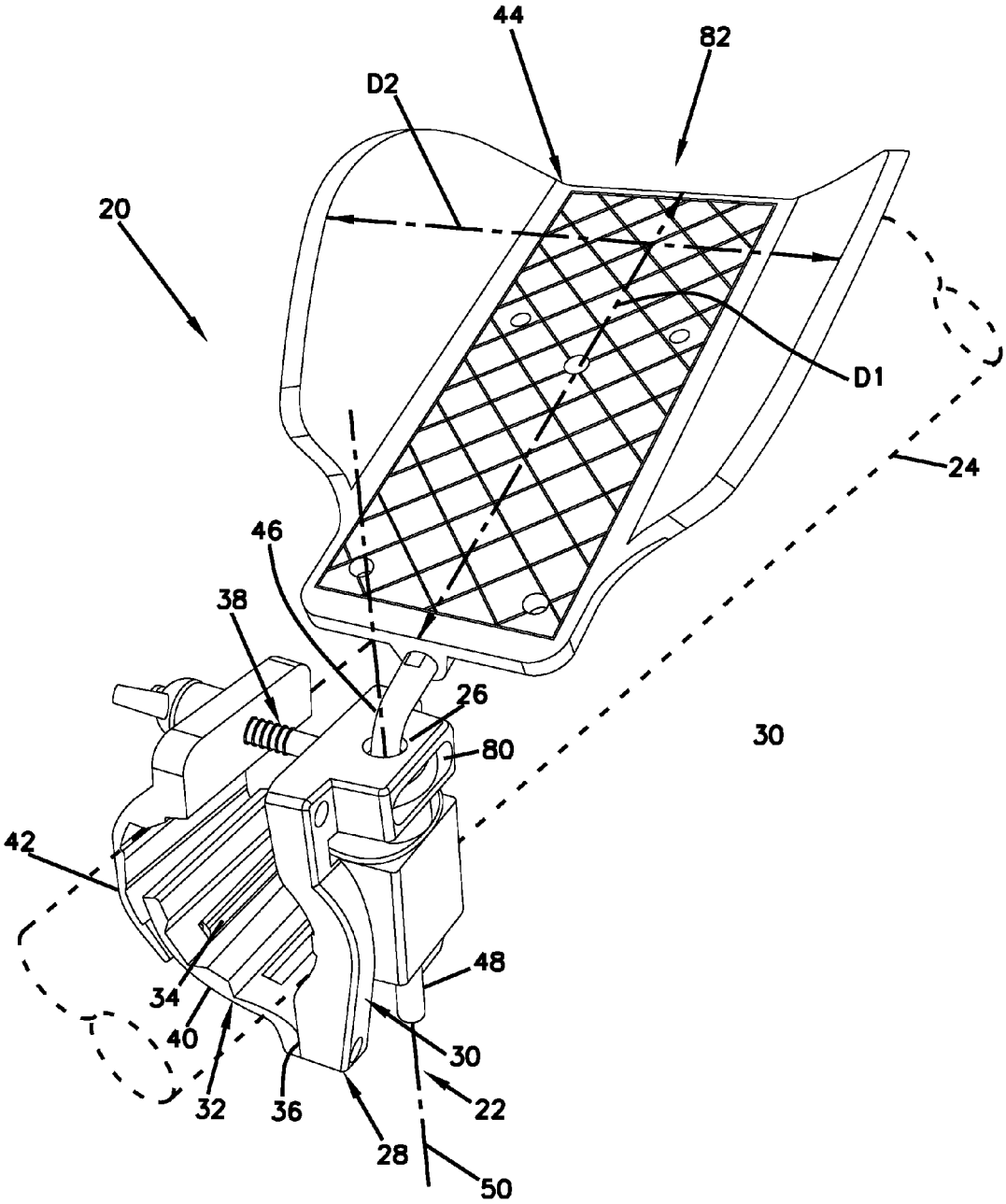
FIG. 1 is a perspective view of an arm support device in accordance with the principles of the present disclosure.

FIGS. 1-5 depict an arm support device 20 in accordance with the principles of the present disclosure. The arm support device 20 is adapted to be mounted on the handle of a device or tool. Example devices and tools having handles on which the arm support device 20 can be mounted include rakes, hoes, fishing rods, shovels, snow shovels, paint rollers, dandelion removers, extendable tree saws, fishing nets, and other devices. The arm support device 20 can also be used on extension handles. In use, the arm support device 20 provides enhanced leverage and support that allows the user to operate the handled tools more efficiently. Additionally, the support provided by the arm support device can reduce the risk of injury. In certain examples, the arm support device 20 provides for arm support while allowing the user to concurrently flex his or her wrist without losing contact between the forearm and the arm support device. In certain examples, a pivot axis of the device extends through the user's wrists so that the arm support device can readily be pivoted when the wrist is flexed.

It will be appreciated that the arm support device 20 is usable with a wide range of devices and tools having different styles and sizes of handles. In this regard, it is desirable for the arm support device 20 to have a coupler that can be adjusted to a wide variety of sizes so as to accommodate the various different styles and sizes of handles for which the arm support device 20 can be used. In certain examples, the arm support device 20 has a coupler with different mechanisms that provide different levels of size adjustment. In certain examples, the coupler of the arm support device can have a first feature that allows rather large adjustments in the coupler size to be made. The coupler of the arm support can also have a complementary second feature or structure that allows more minor or smaller adjustments in the size of the coupler to be made once a particular more major size has been set. Therefore, when sizing the coupler to a certain sized handle, the operator first makes the more coarse or major adjustment to the coupler so as to adjust the coupler to a size which is large enough to receive the handle. Subsequently, the user uses the second adjustment feature to fine-tune the size of the coupler and clamp the coupler onto the handle. In one example, one adjustment feature provides stepped adjustments in size while another adjustment features provides infinite adjustment over a certain size range.

Referring to FIGS. 1-5, the arm support device 20 includes a coupler 22 adapted to be coupled to a handle 24. The coupler 22 defines a pivot opening 26. The coupler 22 includes a clamp 28 including first and second clamp portions 30, 32 between which is defined a receptacle 34 for receiving the handle 24. The first and second clamp portions 30, 32 are joined by a living hinge 36 at a location below the receptacle 34. The coupler 22 includes a fastener 38 passing through the first and second clamp portions 30, 32 at a location above the receptacle 34 for tightening the clamp 28 about the handle 24. The second clamp portion 32 includes first and second segments 40, 42 that can be coupled to each other at a plurality of different positions to adjust a size of the receptacle 34 such that the receptacle can accommodate handles of different sizes. The arm support device 20 also includes an arm support 44 positioned above the coupler 22. The arm support device further includes a pivot pin 46 that connects the arm support 44 to the coupler 22. The pivot pin 46 includes a lower portion 48 that extends downwardly from the arm support 44 to the coupler 22. The lower portion 48 of the pivot pin 46 defines a pivot axis 50 about which the arm support 44 pivots within the pivot opening 26 relative to the coupler 22. The lower portion 48 of the pivot pin 46 is pivotally received within the pivot opening 26 of the coupler 22 such that the lower portion 48 of the pivot pin 46 pivots within the pivot opening 26 about the axis 50 to allow the arm support 44 to pivot relative to the coupler 22.

Figure 2:
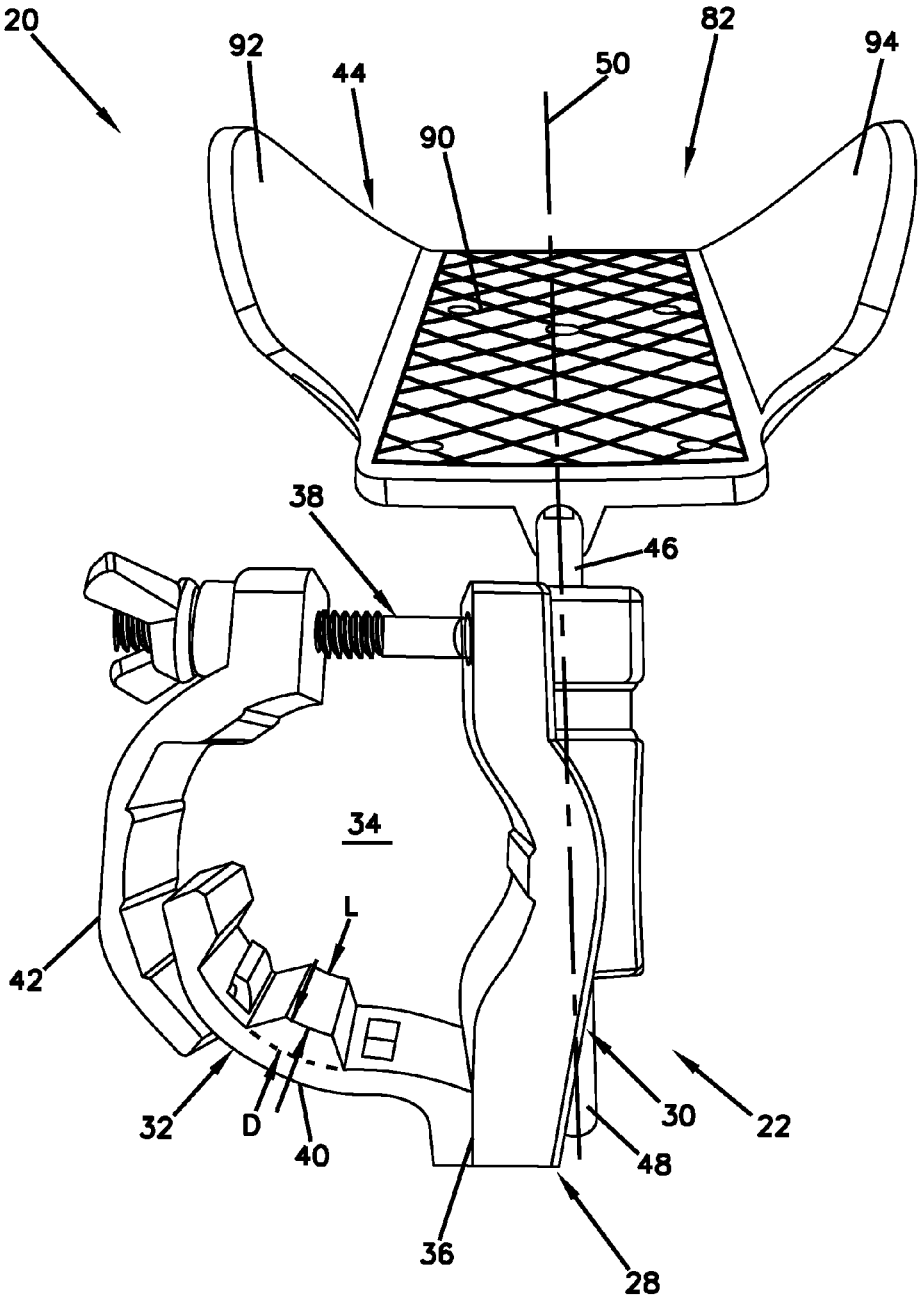
FIG. 2 is a front view of the arm support device of FIG. 2 with a coupler of the arm support device set to an enlarged size.
Figure 3:
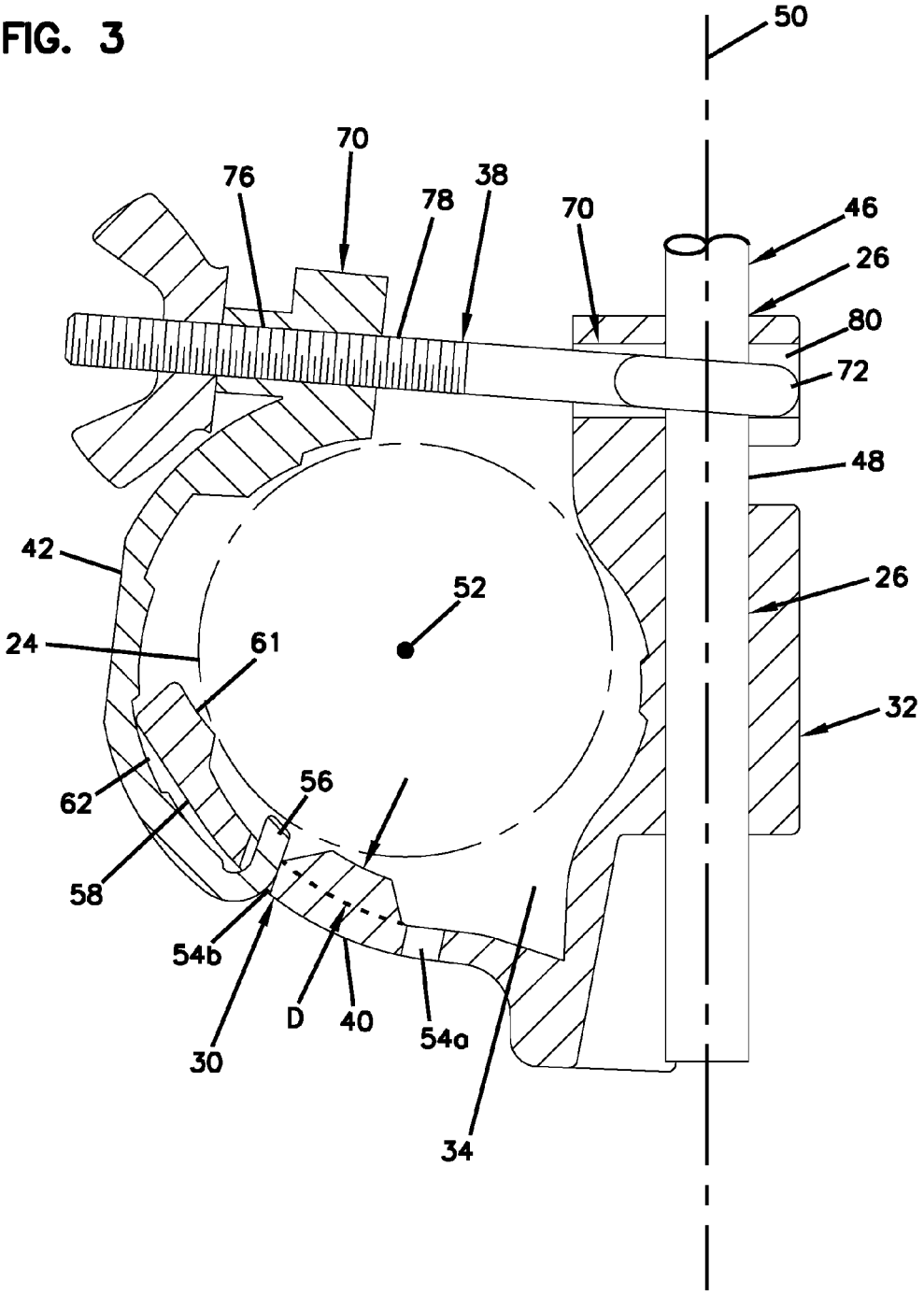
FIG. 3 is a cross-sectional view of the coupler of the arm support device of FIG. 1.
Figure 4:
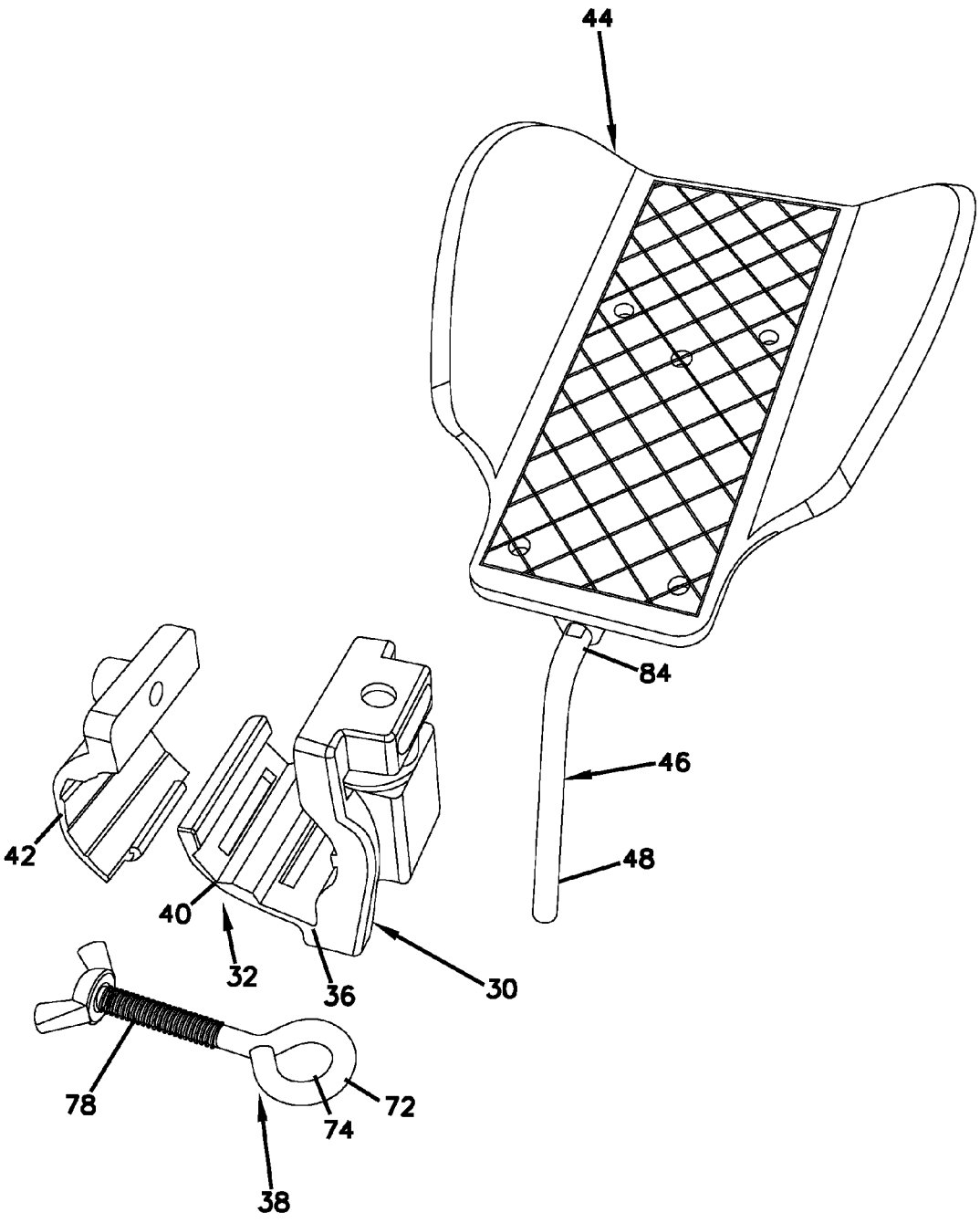
FIG. 4 is a disassembled view of the arm support device of FIG. 1.
Figure 5:
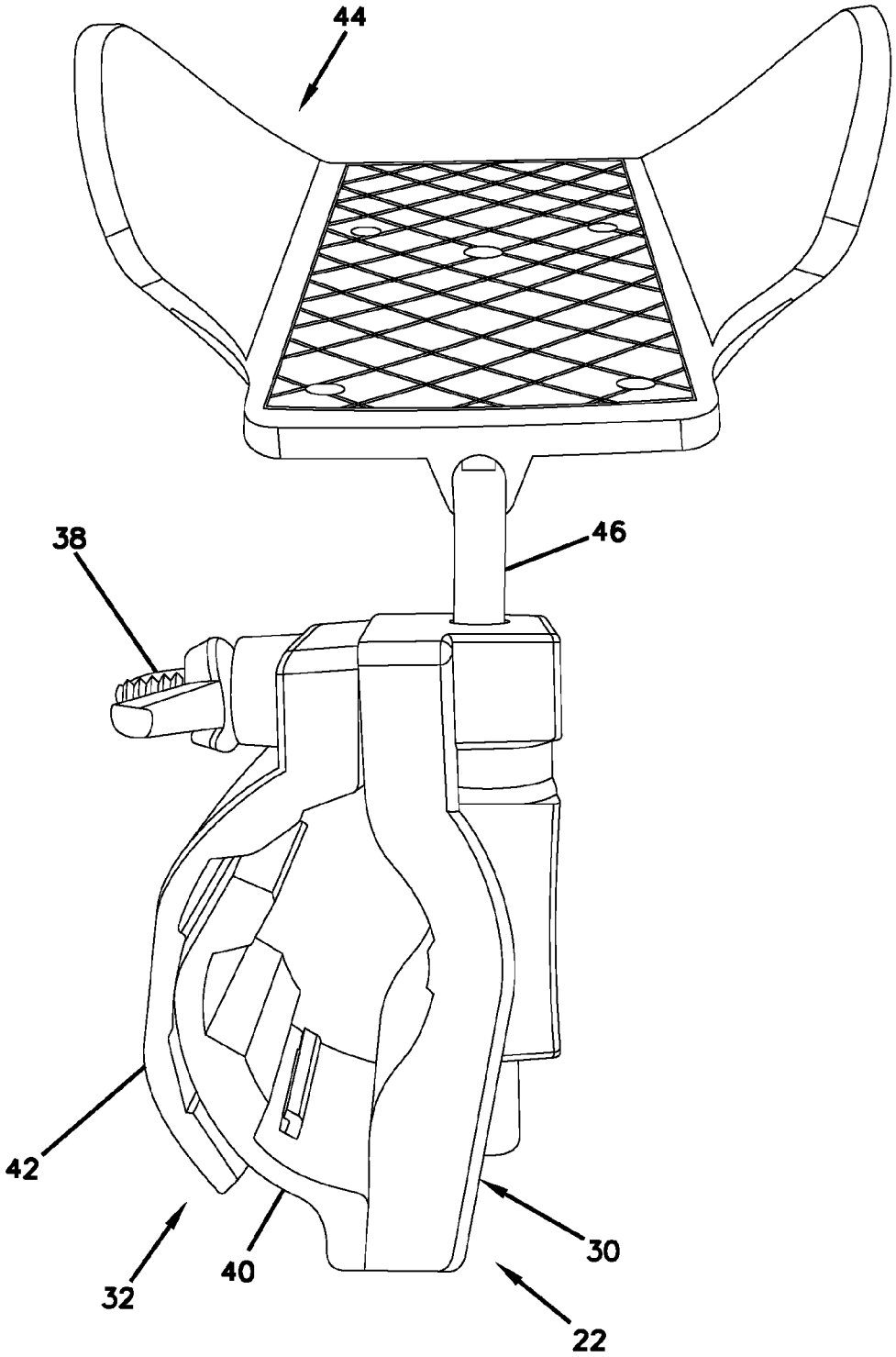
FIG. 5 is a front view showing the arm support device of FIG. 1 with the coupler set to a reduced size.

Referring to FIGS. 1-5, it will be appreciated that by adjusting the relative positions of the first and second segments 40, 42 of the second clamp portion 32, relatively large changes in the size of the receptacle 34 can be made. FIGS. 1-3 show the receptacle 34 set to a relatively large size, while FIG. 5 shows the receptacle 34 set to a smaller size. Once the first and second segments 40, 42 have been set to the appropriate size, the handle 24 can be inserted into the receptacle 34 and the fastener 38 can be tightened to clamp the clamp 28 about the handle 24. It will be appreciated that the fastener 38 combined with the living hinge 36 allows smaller adjustments to be made in the size of the receptacle 34.

Referring still to FIGS. 1-5, the first segment 40 of the second clamp portion 32 is a lower segment that is coupled to the first clamp portion 30 by the living hinge 36. The second segment 42 of the second clamp portion 32 is an upper segment through which the fastener 38 passes.

It will be appreciated that the receptacle 34 defines a central axis 52 (see FIG. 3) that extends through the receptacle 34. When the handle 24 is mounted within the receptacle 34, the central axis 52 can co-axially align with a corresponding axis of the handle 24. As shown at FIG. 3, the first segment 40 of the second clamp portion 32 defines a plurality of connection openings 54*a*, 54*b* spaced apart from one another in an orientation that extends circumferentially about the central axis 52. The second segment 42 of the second clamp portion 32 includes a hook 56 that can be hooked into a selected one of the connection openings 54*a*, 54*b* to couple the first and second segments 40, 42 together. In other examples, the connection openings and the hook can be reversed such that the hook is provided on the first segment 40 and the openings are provided at the second segment 42.

Referring to FIG. 3, the second segment 42 is mounted to overlap an exterior 58 of the first segment 40 and the hook 56 is configured to extend inwardly into the selected one of the connection openings 54*a*, 54*b*. In certain examples, the connection openings 54*a*, 54*b* are through-slots having elongated lengths that are parallel to the central axis 52 of the receptacle 34. In certain examples, the first and second openings 54*a*, 54*b* can be referred to as first and second through-slots 54*a*, 54*b*. As shown at FIGS. 2 and 3, the first segment 40 can include an elongated inner rib 60 that is positioned between the first and second through-slots 54*a*, 54*b*. The inner rib 60 can have a length L that is parallel to the lengths of the through-slots 54*a*, 54*b* and is parallel to the central axis 52 of the receptacle 34. The inner rib 60 has a depth D that projects generally radially inwardly toward the central axis 52 of the receptacle 34. The second segment 42 is shown defining an inner recessed region 62 for receiving an upper end 64 of the first segment 40 to provide a smoother inner diameter transition between the first and second segments 40, 42. The first segment 40 can also include an elongate end rib 61 that is parallel to the rib 60. The second segment 42 can include a plurality of inner recessed regions spaced circumferentially about the axis 52.

Figure 6:
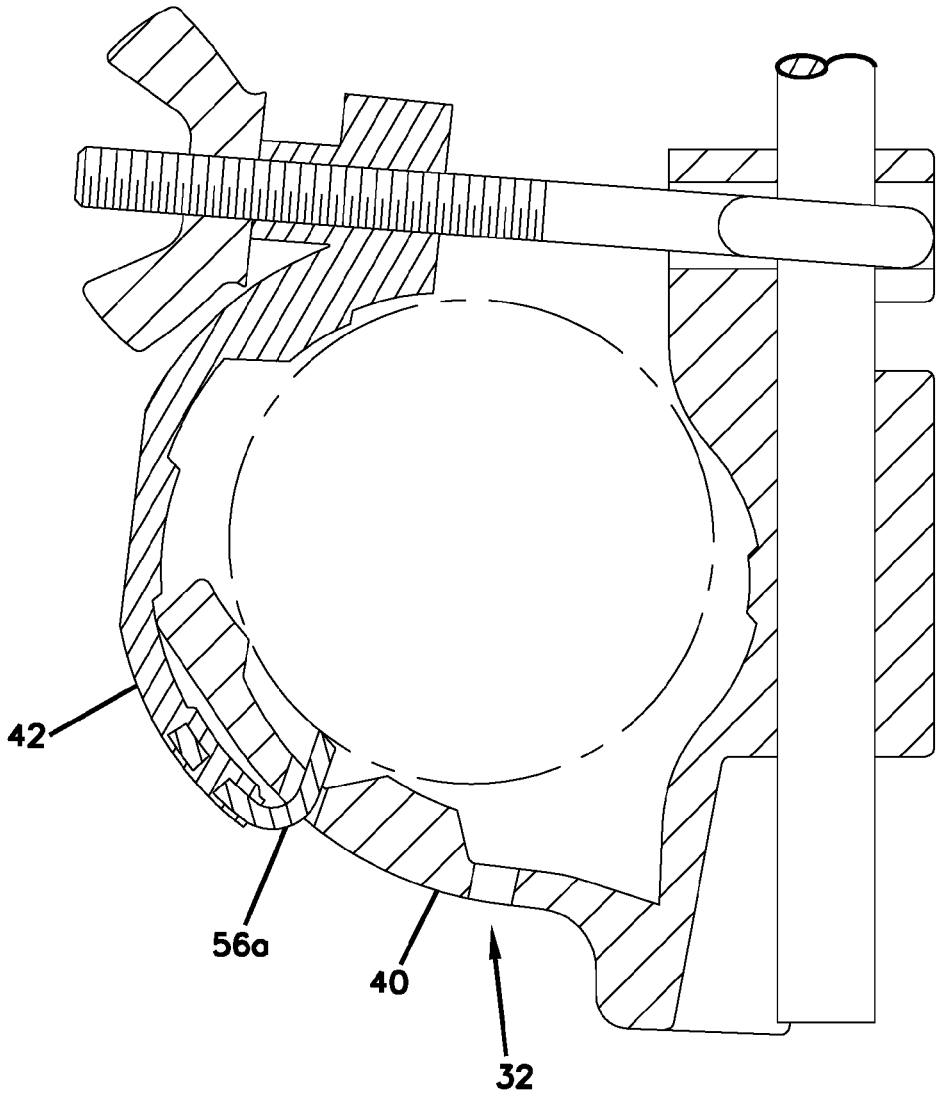
FIG. 6 is a cross-sectional view of an alternative coupler suitable for use with the arm support device of FIG. 1.

In certain examples, the first clamp portion 30 and the first segment 40 of the second clamp portion 32 are unitarily molded as a single first plastic part. The second segment 42 of the second clamp portion 32 can be molded as a second plastic part. In certain examples, the hook 56 has a plastic construction and is unitarily molded as part of the second segment 42. FIG. 6 shows an alternative embodiment having an alternative hook 56*a* constructed of metal that is insert molded into the second segment 42 of the second clamp portion 32.

In certain examples, the coupler 22 also defines a fastener opening 70 that extends across the pivot opening 26. The fastener 38 extends through the fastener opening 70. The fastener 38 is configured for preventing the lower portion 48 of the pivot pin 46 from unintentionally being removed from the pivot opening 26 while allowing the lower portion 48 of the pivot pin 46 to pivot within the pivot opening 26. In certain examples, the fastener 38 functions to clamp the lower portion 48 of the pivot pin 46 within the pivot opening 26.

In certain examples, the fastener 38 includes an eye bolt having an eye portion 72 that defines an eye-bolt opening 74 through which the lower portion 48 of the pivot pin 46 extends when the lower portion 48 of the pivot pin 46 is positioned within the pivot opening 26 of the coupler 22.

The fastener opening 70 of the coupler 22 includes a bore portion 76 defined by the second clamp portion 32 for receiving a shaft 78 of the eye bolt, and a slot portion 80 defined by the first clamp portion 30 for receiving the eye-portion 72 of the eye bolt. The slot portion 80 has an enlarged width as compared to the bore portion 76. In certain examples, the pivot opening 26 of the coupler 22 is oriented in an upright direction and is defined through the first clamp portion 30. The pivot opening 26 is co-axial with the pivot axis 50 of the pivot pin 46. The pivot axis 50 extends generally through a user's wrist when the arm support device is in use.

Referring to FIG. 1, the arm support 44 includes a forearm receiving member defining a channel 82 having a first dimension D1 that extends from an open front end to an open rear end of the channel 82. The first dimension D1 is adapted to be generally parallel to a user's forearm when the user's forearm is positioned within the channel 82. In certain examples, the first dimension D1 extends generally radially outwardly from the pivot axis 50. In certain examples, the channel 82 inclines upwardly from the coupler 22 as the channel 82 extends along the first dimension D1 from the open front end at the pivot axis 50 to the open rear end.

In certain examples, the pivot pin 46 includes a one-piece member having an upper portion 84 secured to the forearm receiving member defining the channel 82 and the lower portion 48 which is received within the pivot opening defined by the coupler 22. The pivot pin 46 defines an obtuse angle between the upper and lower portions 84, 48. In certain examples, the arm support 44 includes an arm cradle that defines the channel 82. The channel 82 opens in an upward direction. The arm cradle includes a bottom base portion 90 and opposing first and second spaced apart walls 92, 94 that extend upwardly from the bottom base portion 90. The bottom base portion 90 and the first and second spaced-apart side walls 92, 94 cooperate to define the channel 82 of the arm cradle. As indicated previously, the channel 82 has an open front end and an open rear end. The bottom base portion 92 of the arm cradle inclines upwardly from the coupler 22 as the channel 82 extends from the open front end to the open rear end. The channel 82 can define a central axis that extends from the open front end to the open rear end of the channel and that intersects the pivot axis 50 of the pivot pin 46.

In certain examples, the clamp 28 can include a top side, a bottom side, a left side, a right side, a front side, and a back side. The receptacle 34 can extend through the clamp 28 from the front side to the back side. The arm support 44 can include the arm cradle having the base portion 90 and the side walls 92, 94 (e.g., left and right side) that define the upwardly facing channel 82 having an open top side. As previously indicated, the channel 82 also has an open front and an open rear end. The channel 82 includes the first dimension D1 and a second dimension D2. The second dimension D2 of the channel 82 extends from the side wall 92 to the side wall 94. The first dimension D1 extends from the open front end to the open rear end of the channel 82. The pivot axis 50 is offset to the left or right of the receptacle 34 and is positioned at a location adjacent the open front end of the channel 82. The first dimension D1 of the channel extends generally radially outwardly from the pivot axis 50.

In other examples, the coupler 22 can be used in combination with other structures, items or devices in addition to arm support device. For example, the clamp 28 of the coupler 22 can be mounted on a support structure (e.g., a mounting rails, mounting handles, mounting poles, mounting rods, pipes, conduits, vertical piping, horizontal conduit, etc.) such that the support structure is clamped within the receptacle 34 of the clamp 28. An item (e.g., a light or lighting fixture, camera, display item, frame, shelf, guide, wire, pipe, conduit, drop ceiling component, plumbing, tubing, etc.) desired to be mounted to the support structure can be mounted to the support structure through the intermediate coupler 22. For example, the item can include a pin that is secured within the pivot opening 26 of the coupler. In this way, the item is secured to the support structure and can be pivoted relative to the support structure by pivoting the pin within the pivot opening 26. In certain examples, the item can be mounted to a frame, platform or other structure coupled to a pin that is received within the pivot opening 26. In this way, the structure including the pivot pin can function as an intermediate adapter for allowing the item to be readily coupled to the coupler 22. In other examples, an item (e.g., tubing, wiring, rods, posts, piping, plumbing, etc.) can be routed directly through the opening 26 without a pivot pin. For example, multiple couplers can be coupled to a pipe (e.g., via the clamps) and used to run/route wire or tubing along the pipe with the wire or tubing being routed through the openings 26.

In regard to the forgoing description, changes may be made in detail, especially with regard to the shape, size, and arrangement of the parts. It is intended that the specification and depicted aspects be considered elective only and not limiting with respect to the broad underlying concepts of the present disclosure.

What is claimed is:

1. An arm support device for use with an item having a handle, the arm support device comprising:

a coupler adapted to be coupled to the handle, the coupler defining a pivot opening, the coupler including a clamp including first and second clamp portions between which is defined a receptacle for receiving the handle of the item, the first and second clamp portions being joined by a living hinge at a location below the receptacle, the coupler including a fastener passing through the first and second clamp portions at a location above the receptacle for tightening the clamp about the handle, the second clamp portion including first and second segments that can be coupled to each other at a plurality of different positions to adjust a size of the receptacle such that the receptacle can accommodate handles of different sizes;

an arm support positioned above the coupler; and a pivot pin that connects the arm support to the coupler, the pivot pin including a lower portion that extends downwardly from the arm support to the coupler, the lower portion of the pivot pin defining a pivot axis about which the arm support pivots relative to the coupler, the lower portion of the pivot pin being pivotally received within the pivot opening of the coupler such that the lower portion of the pivot pin pivots about the pivot axis within the pivot opening to allow the arm support to pivot relative to the coupler.

2. The arm support device of claim 1, wherein the first segment of the second clamp portion is a lower segment that is coupled to the first clamp portion by the living hinge, and wherein the second segment of the second clamp portion is an upper segment through which the fastener passes.

3. The arm support device of claim 2, wherein the receptacle defines a central axis that extends though the receptacle, wherein one of the first and second segments defines a plurality of connection openings spaced-apart from one another in an orientation that extends circumferentially about the central axis, and wherein the other of the first and second segments includes a hook that can be hooked into a selected one of the connection openings to couple the first sand second segments together.

4. The arm support device of claim 3, wherein the first segment defines the connection openings and the second segment includes the hook.

5. The arm support device of claim 4, wherein the second segment mounts overlaps an exterior of the first segment and the hook extends inwardly into the selected one of the connection openings.

6. The arm support device of claim 5, wherein the connection opening are through-slots having elongated lengths parallel to the central axis of the receptacle.

7. The arm support device of claim 6, wherein the through-slots include first and second through-slots, and wherein the first segment includes an elongated inner rib that positioned between the first and second through slots, the inner rib having a length that is parallel to the length of the through-slots and in parallel to the central axis of the receptacle, the inner rib having a depth that projects radially inwardly toward the central axis of the receptacle.

8. The arm support device of claim 7, wherein the second segment defines an inner recessed region for receiving an upper end of the first segment to provide a smoother inner diameter transition between the first and second segments.

9. The arm support device of claim 5, wherein the first clamp portion and the first segment of the second of the second clamp portion are unitarily molded as a first plastic part, wherein the second segment of the second clamp portion is molded as a second plastic part, and wherein the hook has a plastic construction and is unitarily molded as part of the second segment.

10. The arm support device of claim 5, wherein the first clamp portion and the first segment of the second of the second clamp portion are unitarily molded as a first plastic part, wherein the second segment of the second clamp portion is molded as a second plastic part, and wherein the hook has a metal construction and is insert molded into the second segment.

11. The arm support device of claim 1, wherein the coupler also defines a fastener opening that extends across the pivot opening, wherein the fastener extends through the fastener opening, and wherein the fastener is configured for preventing the lower portion of the pivot pin from unintentionally being removed from the pivot opening while allowing the lower portion of the pivot pin to pivot within the pivot opening.

12. The arm support device of claim 11, wherein the fastener clamps the lower portion of the pivot pin within the pivot opening.

13. The arm support device of claim 12, wherein the fastener includes an eye-bolt having an eye-portion that defines a fastener opening through which the lower portion of the pivot pin extends when the lower portion of the pivot pin is positioned within the pivot opening of the coupler.

14. The arm support device of claim 13, wherein the fastener opening includes a bore portion defined by the second clamp portion for receiving a shaft of the eye-bolt, and a slot portion defined by the first clamp portion for receiving the eye-portion of the eye-bolt, the slot portion having an enlarged width as compared to the bore portion.

15. The arm support device of claim 14, wherein the pivot opening of the coupler is oriented in an upright direction and is defined though the first clamp portion.

16. The arm support device of claim 1, wherein the arm support includes a forearm receiving member defining a channel having a first dimension that extends from an open front end to an open rear end of the channel, the first dimension being adapted to be generally parallel to a user's forearm when the user's forearm is positioned within the channel, and wherein the first dimension of the forearm receiving member extends generally radially outwardly from the pivot axis.

17. The arm support device of claim 16, wherein the channel inclines upwardly from the coupler as the channel extends along the first dimension from the open front end to the open rear end.

18. The arm support device of claim 17, wherein the pivot member includes a one piece member having an upper portion secured to the forearm receiving member and the lower portion received within a pivot opening defined by the coupler, and wherein the pivot member defines an obtuse angle between the upper and lower portions.

19. The arm support device of claim 1, wherein the arm support includes an arm cradle defining a channel that opens in an upward direction, the arm cradle including a bottom base portion and opposing, first and second spaced-apart side walls that extend upwardly from the bottom base portion, the bottom base portion and the first and second opposing, spaced-apart side walls cooperating to define the channel of the arm cradle, the channel having an open front end and an open rear end, wherein the bottom base portion of the arm cradle inclines upwardly from the coupler as the channel extends from the open front end to the open rear end, and wherein the channel of the arm cradle defining a central axis that extends from the open front end to the open rear end of the channel and that intersects the pivot axis of the pivot pin.

20. The arm support device of claim 1, wherein the clamp including a top side, a bottom side, a left side, a right side, a front side and a back side, the receptacle extending through the clamp from the front side to the back side, wherein the arm support includes an arm cradle having a base portion and opposing left and right side walls that define an upwardly facing channel having an open top side, an open front end and an open rear end, the channel having a first dimension and a second dimension, the second dimension of the channel extending from the left side wall to the right side wall, and the first dimension extending from the open front end to the open rear end of the channel, wherein the pivot axis is offset to the left or the right of the receptacle and is positioned at a location adjacent the open front end of the arm cradle channel, and wherein the first dimension of the channel extends generally radially outwardly from the pivot axis.

21. A mounting device for mounting an item to a support structure, the mounting device comprising:

a coupler adapted to be coupled to the support structure, the coupler defining an item mounting opening, the coupler including a clamp including first and second clamp portions between which is defined a receptacle for receiving the support structure, the first and second clamp portions being joined by a living hinge at a location below the receptacle, the coupler including a fastener passing through the first and second clamp portions at a location above the receptacle for tightening the clamp about the support structure, the second clamp portion including first and second segments that can be coupled to each other at a plurality of different positions to adjust a size of the receptacle such that the receptacle can accommodate handles of different sizes, the fastener including an eye-bolt having an eye-portion that aligns with the item mounting opening.

* * * * *